US005553729A

United States Patent [19]

Kitano et al.

[11] Patent Number: 5,553,729

[45] Date of Patent: Sep. 10, 1996

[54] INDUCTION HEATING ROLLER APPARATUS

[75] Inventors: Yoshio Kitano; Kozo Okamoto, both of Kyoto, Japan

[73] Assignee: Tokuden Co., Ltd., Kyoto, Japan

[21] Appl. No.: 518,369

[22] Filed: Aug. 23, 1995

[30] Foreign Application Priority Data

Aug. 30, 1994 [JP] Japan ..... 6-243500

[51] Int. Cl.[6] ..... H05B 6/14

[52] U.S. Cl. ..... 219/619; 219/647; 219/469; 29/895.1; 100/93 RP; 492/16; 492/46

[58] Field of Search ..... 219/619, 647, 219/652, 469, 470, 471; 29/895.1, 895.2, 895.1211, 895.222, 895.22, 895.23; 100/93 RP, 93 R, 92; 492/7, 16, 46; 28/240

[56] References Cited

U.S. PATENT DOCUMENTS

| | | | |
|---|---|---|---|
| 5,393,959 | 2/1995 | Kitano et al. | 219/619 |
| 5,421,070 | 6/1995 | Lenk | 28/240 |

FOREIGN PATENT DOCUMENTS

| | | | |
|---|---|---|---|
| 2-106889 | 4/1990 | Japan | 219/619 |
| 2-31999 | 8/1990 | Japan . | |
| 4-36987 | 2/1992 | Japan | 219/619 |

*Primary Examiner*—Philip H. Leung
*Attorney, Agent, or Firm*—Morgan & Finnegan, L.L.P.

[57] ABSTRACT

An induction heating roller apparatus comprises a rotatable hollow cylindrical roller body made of magnetic material, a pair of end frames for closing the opposite opening ends of the roller body, having roller driving shafts in outer sleeve form, magnetic flux generating device comprising an induction coil wound on an iron core body positioned between the pair of end frames and in the hollow portion of the roller body, a pair of sleeve-like rods projecting from the opposite end surfaces of the iron core body and inserted for relative rotation into the outer sleeve of the shafts, and a pair of auxiliary magnetic flux generating mechanism comprising auxiliary induction coils wound on annular iron cores positioned inside the end frames and fixed at the base portion at which the sleeve-like rods are connected to the iron core body, and wherein the end frames comprise fitting edges fitted in the opposite openings in the roller body, flange portions continuous with the fitting edges and adapted to be applied to the opening end edges of the roller body, and conical bodies projecting, while decreasing in diameter, from the integral common locations between the fitting portions and flange portions toward the roller driving shafts, and wherein the axial lengths of at least the annular iron cores in the auxiliary magnetic flux generating mechanism is such that the annular end surfaces opposite to the base portions at which the iron cores are connected to the iron core body are positioned within the range of the conical portions of the end frames.

2 Claims, 2 Drawing Sheets

INDUCTION HEATING ROLLER APPARATUS

TECHNICAL FIELD

The present invention relates to an induction heating roller apparatus, particularly to an induction heating roller apparatus having an end magnetic flux generating mechanism.

PRIOR ART

One of the present inventors has already proposed an induction heating roller apparatus including a magnetic flux generating mechanism disposed in a rotatable hollow cylindrical roller made of magnetic material to cause the peripheral wall of the roller body to generate heat by induction current, said apparatus being characterized in that auxiliary induction coils by which end plates fitted to the roller body to close the opening ends of the latter are caused to generate heat by induction are installed in the roller body (Japanese Utility Model publication No. 31999 of 1990).

According to the aforesaid publication, since the regions of fitting between the roller body and the end plates can be heated, the difference in temperature between the roller body where the magnetic flux density is relatively uniform and the magnetic flux effectively acts, and the end plates where the magnetic flux distribution is biased to diffuse the effect of induction heating in the initial time of a heating process, if there is only provided with the main magnetic flux generating mechanism, can be prevented and so can the formation of a gap in the fitting areas owing to the difference in temperature therebetween. Generally, the heat generated in the principal portion of the roller body tends to produce a heat flow moving toward the ends to which the effect of heat generated by the magnetic flux generating mechanism hardly extends; however, the effect of heating the roller ends and the end plates by the auxiliary induction coils compensates for this heat flow to assure minimum temperature drops in the roller ends, thereby making it possible to shorten the time required for the stabilization of the surface temperature distribution on the roller body.

FIG. 3 shows the arrangement described in said publication, wherein 1 denotes a roller body made of a magnetic material having electric conductivity (or lower electric resistance); 2 denotes end plates for closing the opening end surfaces of the roller body 1; and 3 denotes driving shafts each integrally connected to the end plate 2 and having a through-hole, said driving shafts being rotatably supported in bearings (not shown) fixed on the machine frame. The numeral 5 denotes sleeve-like support rods inserted in the through-holes of the driving shafts 3 and rotatably supported by the driving shafts 3 through bearings 6 and fixed with respect to the machine frame. The pair of support rods 5 support from opposite sides a cylindrical, magnetic flux generating mechanism 7 made integral therewith.

The magnetic flux generating mechanism 7, in the interior of the roller body 1, comprises a cylindrical iron core 8 having a central hole 8A common with the inner holes of the support rods 5, and an induction coil 9 wound therearound. The numeral 10 denotes leads for the induction coil 9 and 11 denotes a surrounding jacket chamber formed in the peripheral wall of the roller body 1, said chamber having sealed therein a heating medium (for example water) alone which is in the two phases, gas and liquid.

The construction of FIG. 3 is symmetrical with respect to a vertical center line, and the end plate 2 at each end comprises an end plate portion 2A, a fitting portion 2B projecting from the end plate portion 2A into the opening n the roller body 1 and fitted therein, and a flange portion 2C which is flush with the end plate portion 2A and which outwardly extends beyond the outer peripheral surface of the fitting portion 2B. The flange portion 2C is fixed to the opening end edge of the roller body 1 by bolts 12.

The numeral 13 denotes auxiliary induction coils disposed inside the roller body 1 and, like the induction coil 9, mounted coaxially with the driving shafts 3 and hence with the support rods 5 between the iron core 8 of the magnetic flux generating mechanism and the end plates 2. The numeral 14 denotes annular iron cores having the auxiliary induction coils 13 wound thereon, said iron cores being fitted on circular step surfaces coaxially formed around the support rods 5 in the central regions of the opposite end surfaces of the iron core body 8. The numeral 15 denotes energizing leads for the auxiliary induction coils 13 and connected to the ac power source as in the case of the leads 10.

When the induction coil 9 is energized to produce an alternating magnetic flux passing through the roller body 1, eddy currents in alternately opposite directions (macroscopically, orbiting currents) are produced to cause said body to generate heat (induction heating). Simultaneously therewith, the auxiliary induction coils 13 are energized, whereupon the end plates 2 generate heat by induction on the same principle, thereby eliminating the possibility of heat flows moving from the roller body 1 to the end plates 2 and to the driving shafts 3, and suppressing the temperature decrease in the vicinity of the ends of the roller body 1; thus, the surface temperature distribution of the roller body 1 stabilizes quickly. Further, since the fitting portions 2B of the end plates are also caused by the auxiliary induction coils 13 to generate heat by induction, the temperature difference and hence the thermal expansion difference between the opening end surfaces of the roller body 1 and the fitting portions 2B are so decreased as to preclude the formation of a gap therebetween. When the roller body 1 is uniformly heated throughout to a desired temperature, the energization of the auxiliary induction coils 13 is cut off but no noticeable heat flow has existed, so that the energization of the main induction coil 9 alone is sufficient to maintain this thermal equilibrium.

Even with such auxiliary heating arrangement, however, since the auxiliary induction coils 13 are installed in limited spaces between the magnetic flux generating mechanism 7 and the end plates 2, the number of turns thereof limited, failing, in some cases, to provide a sufficient size to cause the end plates to generate heat sufficiently.

On the other hand, coaxial installation of the auxiliary induction coils 13 and the fitting portions 2B of the end plates 2 ensures more effective magnetic coupling therefor to allow the fitting portions 2B to generate heat more efficiently. However, since the end plate portions 2A are disposed axially outside the auxiliary induction coils 13 and annular iron cores 14 and connected to the flange portions 2C which are substantially out of the magnetic circuit and also to the driving shafts 3 which are also substantially out of the magnetic circuit, the aforesaid limitation of the size of the auxiliary induction coils prevents the end plate portions 2A from efficiently generating heat, which means that it is impossible to attain rapid stabilization of the surface temperature distribution of the roller body 1.

Further, if the end plate portions 2A are lower in heat generation efficiency than the fitting portions 2B and the temperature of the former becomes relatively lower, then even if the fitting portions 2B try to thermally expand in response to the thermal expansion of the roller body 1, the fitting portions 2B, as restrained end plate portions 2A which do not likewise thermally expand, cannot expand as expected to.

Ultimately, if often occurs that the inherent object of the auxiliary induction coils to prevent formation of a gap between the roller body 1 and the fitting portions 2B cannot be fully attained.

Even if examined locally, the flange portions 2C of the end plates 2 are found to be lower in heat generation efficiency than the end plate portions 2A and its degree of thermal expansion is lower. Therefore, the thermal expansion of the end edges of the roller body 1 is locally restrained, particularly at the threaded fastening regions, by the flange portions 2C, thus spoiling the circularity of the roller body 1 or producing excessive stresses in the end plates 2, sometime leading to fatigue failure.

DISCLOSURE OF THE INVENTION

An object of the present invention is to provide an induction heating roller apparatus designed to provide an increased space necessary for installation of auxiliary induction coils for heat generation by end plates closing the opening end edges of a roller body, thereby allowing flange portions connected to the opening end edges of the roller body to generate heat sufficiently.

To achieve said object, the invention provides an induction heating roller apparatus comprising:

a rotatable hollow cylindrical roller body made of magnetic material, a pair of end frames for closing the opposite opening ends of said roller body, having roller driving shafts projected from the outer central regions thereof, said driving shaft having axial through-holes, magnetic flux generating means comprising an induction coil wound on an iron core body positioned between said pair of end frames and in the hollow portion of said roller body, a pair of sleeve-like rods projecting from the opposite end surfaces of said iron core body and inserted for relative rotation into the axial through-holes of said shafts, and a pair of auxiliary magnetic flux generating means comprising auxiliary induction coils wound on annular iron cores positioned inside said end frames and fixed at the base portions at which said sleeve-like rods are connected to said iron core body, an arrangement being such that exciting currents are fed to said induction coil and auxiliary induction coils through a plurality of lead wires disposed to pass through the hollow portions of the sleeve-like rods, thereby producing a magnetic flux passing through the roller body and end frames, thus causing said body and end frames to generate heat by eddy currents, said induction heating roller apparatus being characterized in that said end frames comprise fitting edges fitted in the opposite openings in said roller body, flange portions continuous with said fitting edges and adapted to be applied to the opening end edges of the roller body, and conical bodies projecting, while decreasing in diameter, from the integral common locations between the fitting portions and flange portions toward said roller driving shafts, and that the axial lengths of at least said annular iron cores in said auxiliary magnetic flux generating means is such that the annular end surfaces opposite to the base portions at which said iron cores are connected to the iron core body are positioned within the range of the conical portions of said end frames.

According to the above arrangement, the conical formation of said end frames allows the outer ends of the auxiliary induction coils to be positioned to extend to or into the conical portions of the end frames. This enlarges the installation space for the auxiliary induction coils relative to the fitting portions and flange portions. Since the end frames are conically formed to allow the auxiliary induction coils to extend into interiors of the cones, the end frames coincide, even if locally, with the auxiliary induction coils terms of axial position. As a result, not only the fitting portions and flange portions but also the corresponding portions of the end frames generate heat by induction efficiently.

BEST MODE FOR CARRYING OUT THE INVENTION

Figure 1:
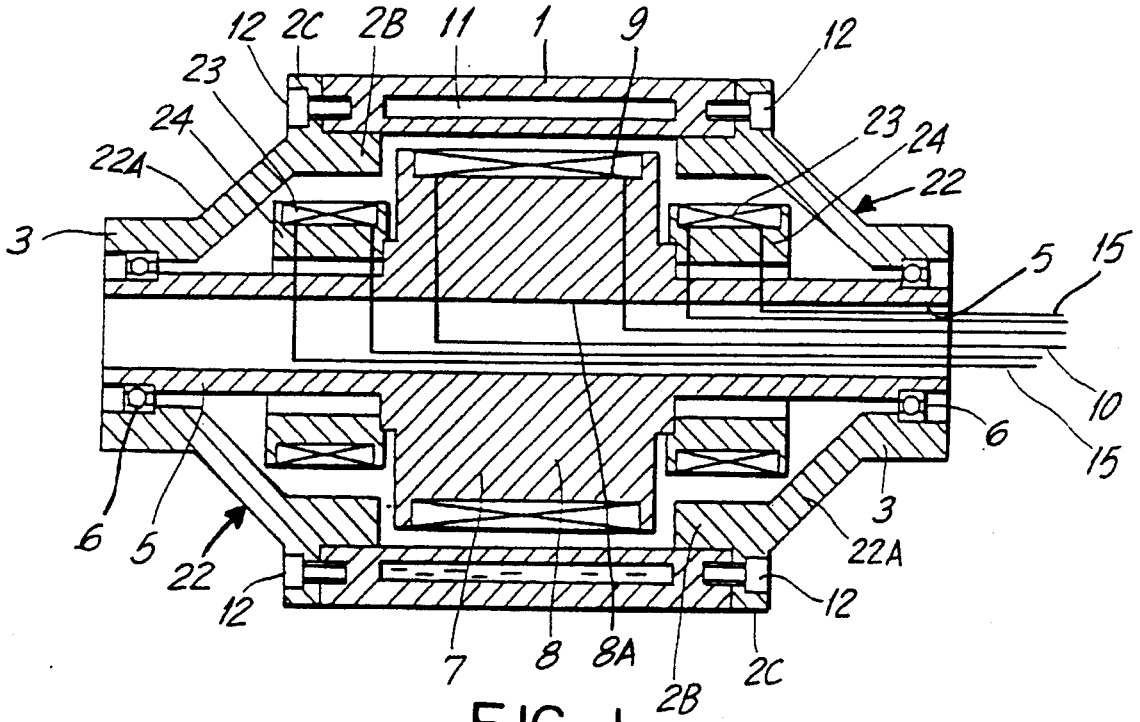
FIG. 1 is a sectional view showing an induction heating roller device according to an embodiment of the invention.
Figure 3:
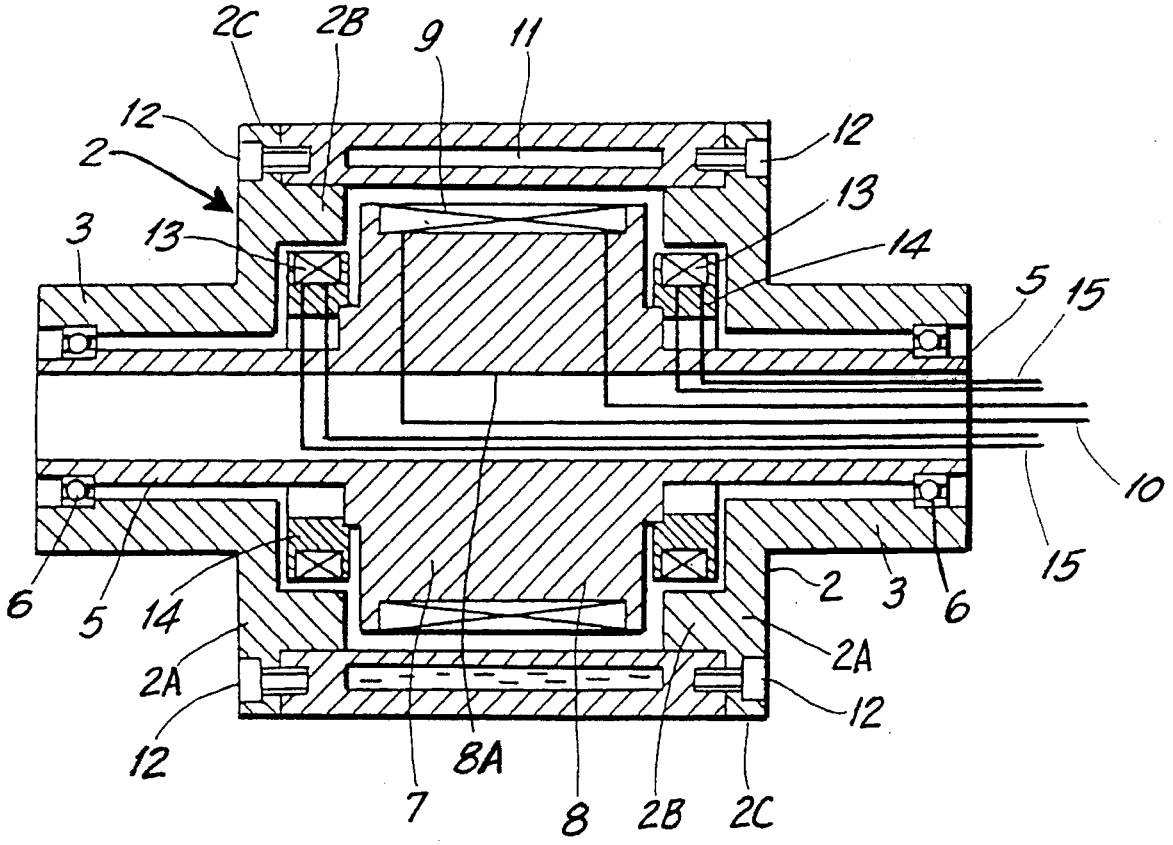
PRIOR ART FIG. 3
FIG. 3 is a sectional view showing a conventional induction heating roller device.

A first embodiment of the present invention will now be described with reference to FIG. 1. Therein, it is to be noted that the parts denoted by the same reference numerals as in FIG. 3 are the same as or correspond to those shown in FIG. 3. An end frame 22 corresponding to a conventional end plate comprises, according to the invention, a fitting edge 2B adapted to fit in each end of a roller body 1, a flange portion 2C, and a body or main portion 22A extending from the inner periphery of the flange portion 2C to a driving shaft 3. The body portion 22A is in the form of a frustum of a cone projecting from the roller body with the center axis defined by the driving shaft 3. The driving shaft 3 continuous with the front end of the conical body portion 22A and the fitting edge 2B continuous with the larger diameter portion, like the conventional end plate, are made of ferromagnetic material, i.e., iron, and are integral with the body portion 22A.

An auxiliary induction coil 23 is wound on an annular iron core 24 supported on an annular step surface on the core body 8 at each end thereof, with the axial outer end of the coil extending into the interior of the conical body portion 22A of the end frame 22, the inner end of the coil being positioned in opposed relation to one end of the iron core body 8 in the magnetic flux generating mechanism. With this arrangement, the auxiliary induction coil 23 is not only opposed to the fitting edge 2B and extends over a corresponding range but also is supported by the field core having an axial length extending beyond the axial position of the flange portion 2C to reach the interior of the conical body portion 22A.

According to such arrangement, the installation space for the auxiliary induction coil 23 extending to the interior of the conical body portion 22A is greater than that in the conventional arrangement; thus, feeding an exciting current to the coil as well as to the main induction coil 9 ensures that not only the fitting edge 2B but also the flange portion 2C generate sufficient heat. As a result, the difference in thermal expansion between the roller body 1 and the end frame 22 is very small and the circularity of the roller body 1 is well maintained.

Particularly, the region of the conical body portion 22A which is on the larger diameter side and which is adjacent and opposed to the auxiliary induction coil also generates heat by induction, with the result that a thermal expansion which, as expected, is identical with the thermal expansion of the roller body is produced in the vicinity of the fitting edge 2B, thus making it possible to prevent the formation of a gap between the roller body 1 and the fitting edge 2B.

Figure 2:
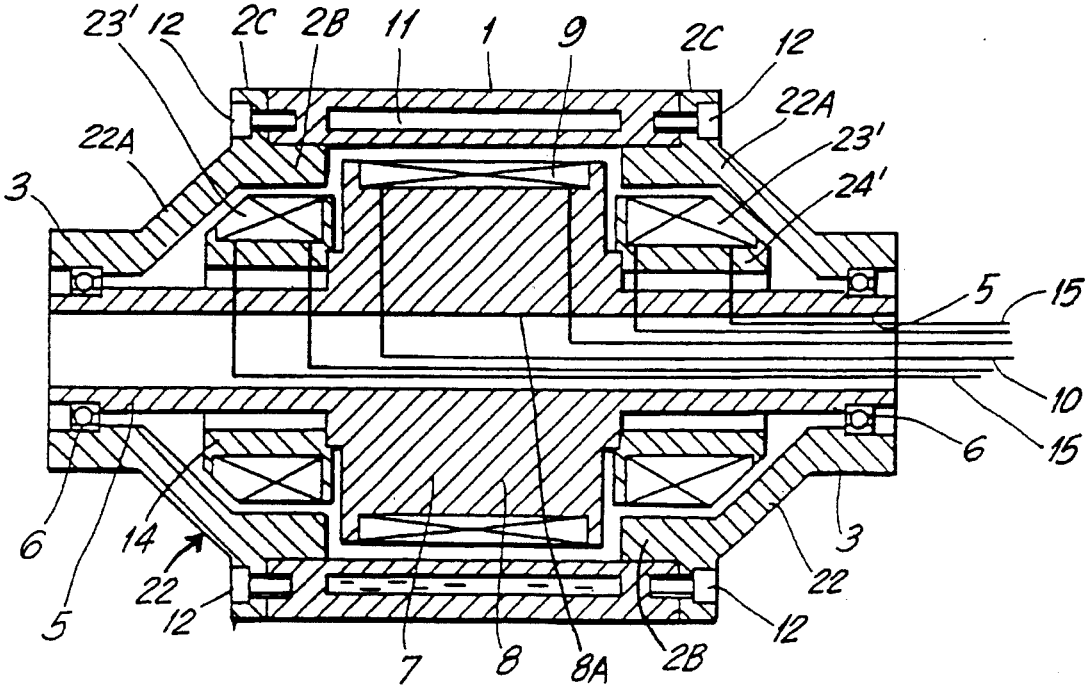
FIG. 2 is a sectional view showing an induction heating roller device according to a second embodiment of the invention.

FIG. 2 shows another embodiment of the invention, wherein the axial outer end of the auxiliary induction coil 23', i.e., the portion thereof extending into the interior of the conical body portion 22A of the end frame has an inclined surface extending along the inclination of the cone of the portion 22A, and correspondingly the diameter of the front end edge of the annular iron core 24' is also decreased.

This arrangement makes it possible to increase the number of turns of the auxiliary induction coil 23', to position its outer peripheral surface closer to the fitting edge 2B and to increase the overall ampere-turn value of the auxiliary induction coil 23'. It is thought that the more the smaller diameter portion of the conical body portion 22A is approached, the smaller the number of turns of the auxiliary induction coil 23' in the cross-section associated therewith and the less the local effect of electromagnetic induction concerning the body portion 22A. Therefore, the auxiliary induction coil 23' of this form can rationally allow the thermal expansion of the conical body portion 22A to follow the thermal expansion of the fitting edge 2B of the end frame 22 according to the diameter.

In addition, the auxiliary induction coil 23 or 23', like the auxiliary induction coil in the conventional device, is energized at the same time as the induction coil 9 is energized and the energization of the auxiliary induction coil is preferably cut off when the surface temperature of the roller body 1 becomes uniform throughout the surface.

INDUSTRIAL APPLICABILITY

As has been described so far, according to the invention, in installing auxiliary induction coils in the ends of the roller body, the installation spaces therefor can be increased to minimize temperature drops in said ends, without spoiling the circularity of the roller body, while avoiding production of excessive thermal stress.

What is claimed is:

1. An induction heating roller apparatus comprising:

a rotatable hollow cylindrical roller body made of magnetic material.

a pair of end frames for closing the opposite opening ends of said roller body, having roller driving shafts projected from the outer central regions thereof, said driving shaft having axial through-holes, magnetic flux generating means comprising an induction coil wound on an iron core body positioned between said pair of end frames and in the hollow portion of said roller body, a pair of sleeve-like rods projecting from the opposite end surfaces of said iron core body and inserted for relative rotation into the axial through-holes of said shafts, and a pair of auxiliary magnetic flux generating means comprising auxiliary induction coils wound on annular iron cores positioned inside said end frames and fixed at the base portion at which said sleeve-like rods are connected to said iron core body, an arrangement being such that exciting currents are fed to said induction coil and auxiliary induction coils through a plurality of lead wires disposed to pass through the hollow portions of the sleeve-like rods, thereby producing a magnetic flux passing through the roller body and end frames, thus causing said body and end frames to generate heat by eddy currents, said induction heating roller apparatus being characterized in that said end frames comprise fitting edges fitted in the opposite openings in said roller body, flange portions continuous with said fitting edges and adapted to be applied to the opening end edges of the roller body, and conical bodies projecting, while decreasing in diameter, from the integral common locations between the fitting portions and flange portions toward said roller driving shafts, and that the axial lengths of at least said annular iron cores in such said auxiliary magnetic flux generating means is such that the annular end surfaces opposite to the base portions at which said iron cores are connected to the iron core body are positioned within the range of the conical portions of said end frames.

2. An induction heating roller apparatus as set forth in claim 1, characterized in that the end of said auxiliary induction coil which extends to the interior of the conical portion of said end frame is shaped as cone extending along the inner peripheral surface of the said conical portion.

* * * * *